US012582864B2

(12) United States Patent
Lee et al.

(10) Patent No.: US 12,582,864 B2
(45) Date of Patent: Mar. 24, 2026

(54) MAT-TYPE EXERCISE DEVICE

(71) Applicant: LG ELECTRONICS INC., Seoul (KR)

(72) Inventors: Taehee Lee, Seoul (KR); Seyoung Woo, Seoul (KR); Jeongjoon Roh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 68 days.

(21) Appl. No.: 18/698,871

(22) PCT Filed: Oct. 7, 2022

(86) PCT No.: PCT/KR2022/015099
§ 371 (c)(1),
(2) Date: Apr. 5, 2024

(87) PCT Pub. No.: WO2023/059122
PCT Pub. Date: Apr. 13, 2023

(65) Prior Publication Data

US 2025/0242192 A1 Jul. 31, 2025

(30) Foreign Application Priority Data

Oct. 7, 2021 (KR) ..... 10-2021-0133236
Feb. 8, 2022 (KR) ..... 10-2022-0016357

(51) Int. Cl.
*A63B 21/00* (2006.01)
*A63B 21/005* (2006.01)

(52) U.S. Cl.
CPC ..... *A63B 21/153* (2013.01); *A63B 21/0058* (2013.01); *A63B 21/4035* (2015.10)

(58) Field of Classification Search
CPC ..... A63B 21/153; A63B 21/0058; A63B 21/4035; A63B 21/00047; A63B 23/1209;
(Continued)

(56) References Cited

U.S. PATENT DOCUMENTS 8,465,401 B1 6/2013 Ihli et al.
2010/0204023 A1 8/2010 Mills et al.
(Continued)

FOREIGN PATENT DOCUMENTS

CN 212631588 3/2021
GB 624 303 6/1949
(Continued)

OTHER PUBLICATIONS

International Search Report dated Jan. 19, 2023 issued in Application No. PCT/KR2022/015099.
(Continued)

*Primary Examiner* — Andrew S Lo
(74) *Attorney, Agent, or Firm* — KED & ASSOCIATES, LLP

(57) ABSTRACT

Proposed is a mat-type exercise device. The mat-type exercise device may include a plurality of wheel modules. Each of the plurality of wheel modules is installed in the device body such that the wheel module can move between a protrusion position at which the wheel module protrudes from the lower surface of the device body and an introduction position at which the wheel module is introduced to the inside of the lower surface of the device body. Additionally, a plurality of switching modules switches the position of at least one of the plurality of wheel modules between the protrusion position and the introduction position. Accordingly, the mat-type exercise device is secured to move horizontally when the wheel module is located at the protrusion position, and stable exercise is secured when the wheel module is located at the introduction position.

12 Claims, 8 Drawing Sheets

(58) Field of Classification Search
CPC ..... A63B 23/1281; A63B 21/0442; A63B 23/03525; A63B 2071/025; A63B 2071/027; A63B 2208/0204; A63B 2208/0242; B60B 33/063
See application file for complete search history.

(56) References Cited

U.S. PATENT DOCUMENTS

| | | | | |
|---|---|---|---|---|
| 2010/0255966 | A1 | 10/2010 | Aucamp | |
| 2018/0099180 | A1 | 4/2018 | Wilkinson | |
| 2019/0076691 | A1 | 3/2019 | Smith | |
| 2019/0344123 | A1* | 11/2019 | Rubin | A63B 21/153 |
| 2020/0307860 | A1* | 10/2020 | Freedman | H02J 7/0013 |
| 2021/0236876 | A1 | 8/2021 | Gregory | |
| 2021/0362001 | A1* | 11/2021 | Crawley | A63B 21/4033 |
| 2023/0414986 | A1* | 12/2023 | Woo | A63B 21/153 |
| 2024/0316393 | A1* | 9/2024 | Muth | A63B 71/0622 |

FOREIGN PATENT DOCUMENTS

| | | |
|---|---|---|
| JP | 2007 259892 | 10/2007 |
| KR | 10-2002-0062487 | 7/2002 |
| KR | 10-2053683 | 12/2019 |
| WO | WO 2015/137566 | 9/2015 |
| WO | WO 2022/075864 | 4/2022 |
| WO | WO 2022/103278 | 5/2022 |

OTHER PUBLICATIONS

Extended European Search Report dated Jul. 11, 2025, issued in Application No. 22878686.9.
Extended European Search Report dated Jul. 11, 2025, issued in Application No. 22878943.4.
European Search Report dated May 27, 2025 issued in Application No. 22878687.7.

* cited by examiner

MAT-TYPE EXERCISE DEVICE

CROSS-REFERENCE TO RELATED PATENT APPLICATIONS

This application is a U.S. National Stage Application under 35 U.S.C. § 371 of PCT Application No. PCT/KR2022/015099, filed Oct. 7, 2022, which claims priority to Korean Patent Application Nos. 10-2021-0133236, filed Oct. 7, 2021 and 10-2022-0016357, filed Feb. 8, 2022, whose entire disclosures are hereby incorporated by reference.

TECHNICAL FIELD

The present disclosure relates generally to an exercise device and, more particularly, to a mat-type exercise device on which a user can exercise while the mat-type exercise device is seated on a floor.

BACKGROUND ART

In general, an exercise device used for increasing muscular strength is designed to repeat muscle relaxation and contraction while a lever connected to a weight of a predetermined unit of weight is pushed or pulled.

Among such exercise devices, there are various types of exercise devices, such as an arm curl machine for biceps exercises, a chest press or butterfly machine for exercises for chest, such as pectoralis major, and a pull-up device for a muscle exercise.

Recently, as part of self-management, a home workout, which is exercise for health management at home which is my own resting place without jogging or visiting a fitness center has become an issue. In response to this issue, various types of exercise devices for a home workout have been proposed, and a new phrase called a home workout group has been created.

Among exercise devices for a home workout, an exercise device, such as a mat-type exercise device, may be proposed for a user to exercise while standing on the associated exercise device.

It is preferable to secure the mobility of the mat-type exercise device such that a user moves the exercise device to a desired location to exercise. When the mat-type exercise device includes a component such as a motor, it is practically difficult for a user to directly carry the exercise device. Accordingly, in the case of the mat-type exercise device, it is preferable to ensure the free horizontal movement of the exercise device with respect to the floor.

However, even if the free horizontal movement of the mat-type exercise device is ensured, the free horizontal movement should not decrease a user's stability when the user exercises on the mat-type exercise device.

Accordingly, the mat-type exercise device whose horizontal movement is ensured and on which stable exercise can be performed is required.

DISCLOSURE OF INVENTION

Technical Problem

The present disclosure is intended to propose a mat-type exercise device whose horizontal movement is ensured and on which stable exercise can be performed.

In addition, the present disclosure is intended to propose a mat-type exercise device in which manipulation for moving the mat-type exercise device, and manipulation for seating the mat-type exercise device on a floor for stable exercise are easy.

Furthermore, the present disclosure is intended to propose a mat-type exercise device in which multiple moving wheels can be moved in and out of a device body by one manipulation.

Solution to Problem

According to an embodiment of the present disclosure, a mat-type exercise device may include a device body. The device body may provide an exercise load required for exercise.

According to the embodiment of the present disclosure, the mat-type exercise device may include a cable. The cable may extend to the outside from the device body and may transmit an exercise load from the device body.

According to the embodiment of the present disclosure, the mat-type exercise device may include a plurality of wheel modules. Each of the plurality of wheel modules may be installed in the device body such that the wheel module can move between a protrusion position at which the wheel module protrudes from the lower surface of the device body and an introduction position at which the wheel module is introduced to the inside of the lower surface of the device body.

According to the embodiment of the present disclosure, the mat-type exercise device may include a plurality of switching modules. The plurality of switching modules may switch the position of at least one of the plurality of wheel modules between the protrusion position and the introduction position.

In the embodiment of the present disclosure, the plurality of wheel modules may be installed in pairs by being spaced apart from each other in width direction of the device body at the opposite edges of the device body in longitudinal direction thereof. In addition, the plurality of switching modules may be installed respectively on the opposite sides of the device body in the longitudinal direction thereof and may switch the pairs of wheel modules.

According to the embodiment of the present disclosure, the wheel module may include a holding jaw part. The holding jaw part may include a first surface directed to the introduction position and a second surface directed to the protrusion position.

According to the embodiment of the present disclosure, the switching module may include a holding rib. The holding rib may be in contact with the first surface of the holding jaw part when the wheel module is located at the protrusion position such that the wheel module can be maintained at the protrusion position. Additionally, the holding rib may be in contact with the second surface of the holding jaw part when the wheel module is located at the introduction position such that the wheel module can be maintained at the introduction position.

According to the embodiment of the present disclosure, the switching module may be installed in the device body such that the holding rib can move between a holding position and a holding release position. Here, at the holding position, the holding rib may be in contact with the first surface or the second surface. Additionally, at the holding release position, the holding rib may be removed from the first surface or the second surface to be released from being held by the holding jaw part.

According to the embodiment of the present disclosure, the wheel module may include a wheel body. The wheel body may be installed in the device body such that the wheel body can move between the protrusion position and the introduction position. Furthermore, the holding jaw part may be formed on the outer side of the wheel body in a radial direction thereof.

According to the embodiment of the present disclosure, the wheel module may include a moving wheel. The moving wheel may be installed on the end of the wheel body by being directed to the protrusion position.

According to the embodiment of the present disclosure, the wheel module may include a first elastic member. The first elastic member may press the wheel body toward the protrusion position. Accordingly, when the holding rib moves from the holding position at which the holding rib is in contact with the second surface of the holding jaw part to the holding release position, the wheel body may be moved toward the protrusion position by the elastic force of the first elastic member.

In the embodiment of the present disclosure, when the holding rib moves from the holding position at which the holding rib is in contact with the first surface of the holding jaw part to the holding release position, the device body may move toward the protrusion position while the moving wheel is in contact with a floor, and the weight of the device body may overcome the elastic force of the first elastic member and thus the wheel body may be introduced into the device body.

In the embodiment of the present disclosure, the second surface of the holding jaw part and the surface of the holding rib in contact with the second surface when the wheel body is located at the introduction position may be formed slantingly along the moving direction of the holding rib to face with each other.

According to the embodiment of the present disclosure, the wheel module may further include a wheel guide member. The wheel guide member may be installed inside the device body. In addition, the wheel guide member may guide the movement of the wheel body between the protrusion position and the introduction position.

Here, a plurality of wheel guide bars may be formed in the wheel body. Each of the wheel guide bars may be formed by protruding toward the wheel guide member. Furthermore, a plurality of wheel guide grooves may be formed at positions of the inside of the wheel guide member, which correspond to the positions of the wheel guide bars, so as to guide the movement of the wheel guide bars.

The wheel guide member may have an opening into which the wheel guide bars are inserted, and the wheel guide grooves may be formed in the inner wall surface of the wheel guide member.

According to the embodiment of the present disclosure, the switching module may include a handle part. The handle part may be exposed to the outside of the device body such that a user can grip the handle part.

According to the embodiment of the present disclosure, the switching module may include a pair of wheel switching parts. In the device body, the pair of wheel switching parts may extend respectively to the opposite sides of the width direction from the handle part and may switch the positions of the pair of wheel modules, respectively.

In the embodiment of the present disclosure, the holding rib may be formed in the wheel switching part. Additionally, manipulation by the handle part may be transmitted through each of the wheel switching parts to the holding rib such that the holding rib moves between the holding position and the holding release position.

In the embodiment of the present disclosure, the handle part and the pair of wheel switching parts may be installed in the device body so as to reciprocate in the longitudinal direction of the device body. Here, when the handle part moves outward in the longitudinal direction, the holding rib may move to the holding release position. Additionally, when the handle part moves inward in the longitudinal direction, the holding rib may move to the holding position.

According to the embodiment of the present disclosure, the switching module may include at least one second elastic member. The second elastic member may press at least one of the handle part and the wheel switching part inward in the longitudinal direction. Accordingly, the holding position of the holding rib may be maintained by the elastic force of the second elastic member.

According to the embodiment of the present disclosure, a wheel through hole may be formed in the wheel switching part. The wheel through hole may be formed through the wheel switching part to be directed toward the protrusion position such that the wheel module passes through the inside of the wheel through hole.

According to the embodiment of the present disclosure, the switching module may include a switching guide member. The switching guide member may be installed inside the device body so as to guide the reciprocating movement of each of the wheel switching parts in the longitudinal direction of the device body.

According to the embodiment of the present disclosure, a switching guide rib may be formed on one of the switching guide member and the wheel switching part, and a switching guide groove may be formed in a remaining one of the switching guide member and the wheel switching part. The switching guide rib may be formed by protruding toward the switching guide groove in the longitudinal direction of the device body. In addition, the switching guide rib may be inserted into the switching guide groove such that the movement of the wheel switching part in the longitudinal direction is guided.

Advantageous Effects of Invention

The mat-type exercise device of the present disclosure may have one or more of the following effects.

First, the plurality of wheel modules may be configured to be moved into and out of the device body, thereby ensuring the horizontal movement of the mat-type exercise device when the wheel modules are located at protrusion positions, and ensuring a stable exercise with the mat-type exercise device when the wheel modules are located at introduction positions.

Second, the plurality of wheel modules may be installed in pairs by being spaced apart from each other in the width direction of the device body on the opposite sides of the device body in the longitudinal direction thereof, thereby enabling the horizontal movement of the mat-type exercise device with a small force.

Third, the wheel module may be moved out to the protrusion position by the elastic force of the first elastic member only by manipulating the switching module after slightly raising one side of the device body, thereby providing the convenience of manipulation for moving the wheel module out to protrusion position.

Fourth, the wheel module may be moved to the introduction position by the weight of the device body after only the switching module is manipulated, thereby providing the convenience of manipulation for moving the wheel module to the introduction position.

Fifth, one switching module may be configured to move two wheel modules in and out of the device body, thereby simplifying the movement of the wheel modules in and out the device body.

BEST MODE FOR CARRYING OUT THE INVENTION

A mat-type exercise device according to an embodiment of the present disclosure may include a plurality of wheel modules. Each of the plurality of wheel modules may be installed in the device body such that the wheel module can move between a protrusion position at which the wheel module protrudes from the lower surface of a device body and an introduction position at which the wheel module is introduced to the lower surface of the device body. In addition, a plurality of switching modules may switch the position of at least one of the plurality of wheel modules between the protrusion position and the introduction position.

MODE FOR THE INVENTION

Hereinafter, a mat-type exercise device according to an embodiment of the present disclosure will be described in detail with reference to the accompanying drawings.

Figure 1:
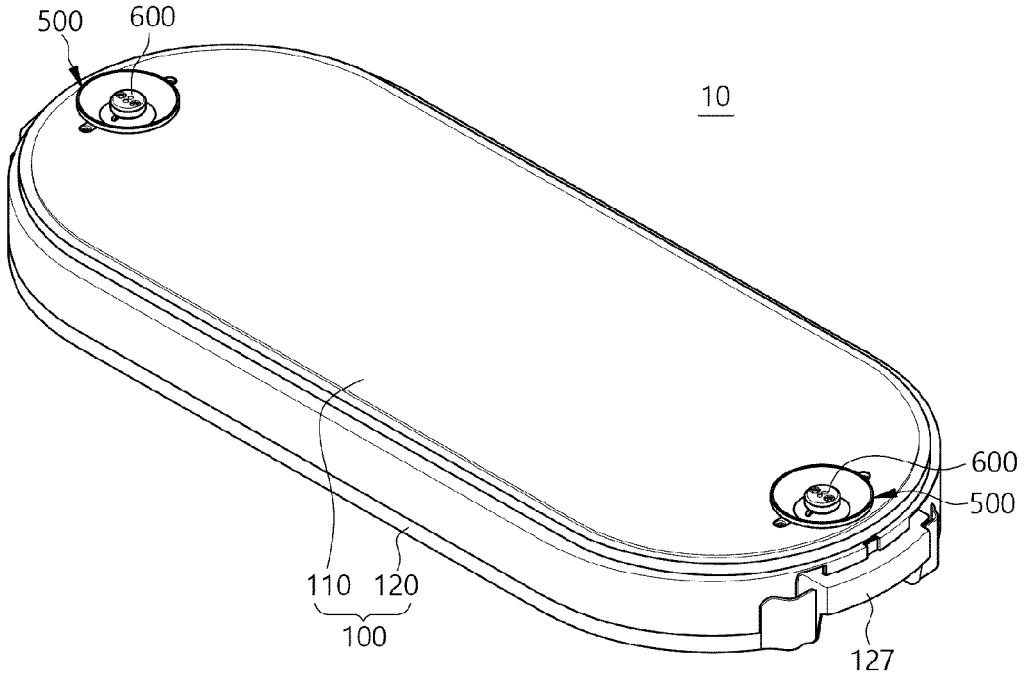
FIG. 1 is a perspective view of a mat-type exercise device according to an embodiment of the present disclosure.

FIG. 1 is a perspective view of the mat-type exercise device 10 according to the embodiment of the present disclosure.

Referring to FIG. 1, the mat-type exercise device 10 according to the embodiment of the present disclosure may be used in such a manner that a user exercises on the top of the mat-type exercise device 10 while the mat-type exercise device 10 is seated on the floor indoors or outdoors.

The mat-type exercise device 10 according to the embodiment of the present disclosure may include a device body 100. The device body 100 may constitute the entire exterior of the mat-type exercise device 10 according to the embodiment of the present disclosure and may have an approximately rectangular parallelepiped shape.

The device body 100 according to the embodiment of the present disclosure has a shape in which length in a horizontal direction is longer than length in a direction perpendicular thereto, and hereinafter will be described by defining long horizontal direction as a longitudinal direction and defining a relatively short perpendicular direction as a width direction.

The mat-type exercise device 10 according to the embodiment of the present disclosure may further include a cable 200. The cable 200 may extend outward from the device body 100 and may transmit an exercise load provided from the device body 100 to a user. That is, in the mat-type exercise device of the present disclosure, in an exercise process in which a user pulls the cable 200 and returns the same to an initial position, the user may exercise through an exercise load applied to the user when the cable is pulled.

The device body 100 according to the embodiment of the present disclosure may include an upper casing 110 and a lower casing 120. Additionally, the mat-type exercise device 10 according to the embodiment of the present disclosure may further include a drive module which provides an exercise load.

The upper casing 110 and the lower casing 120 may be coupled to each other in a vertical direction and may have a receiving space defined therein. Additionally, the drive module may be installed in the receiving space of the inside of the device body 100 and may supply an exercise load through the cable 200.

Figure 2:
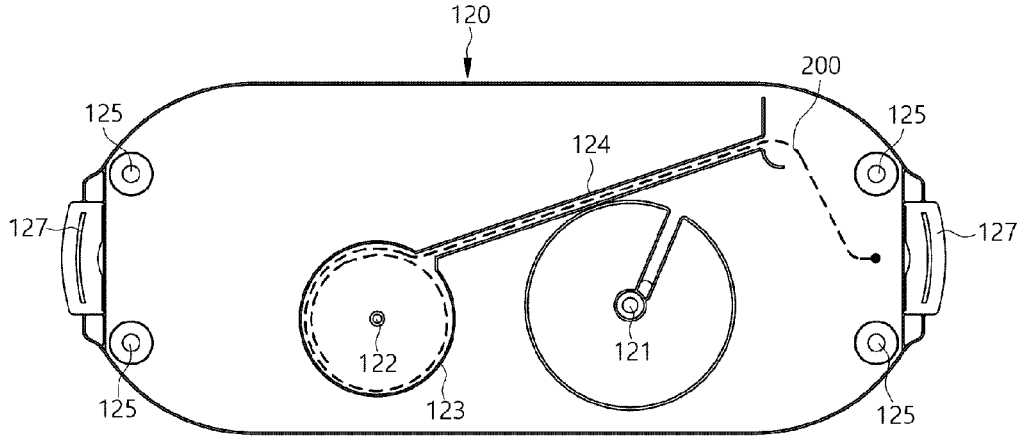
FIG. 2 is a top plan view illustrating the inside of a lower casing according to the embodiment of the present disclosure.
Figure 3:
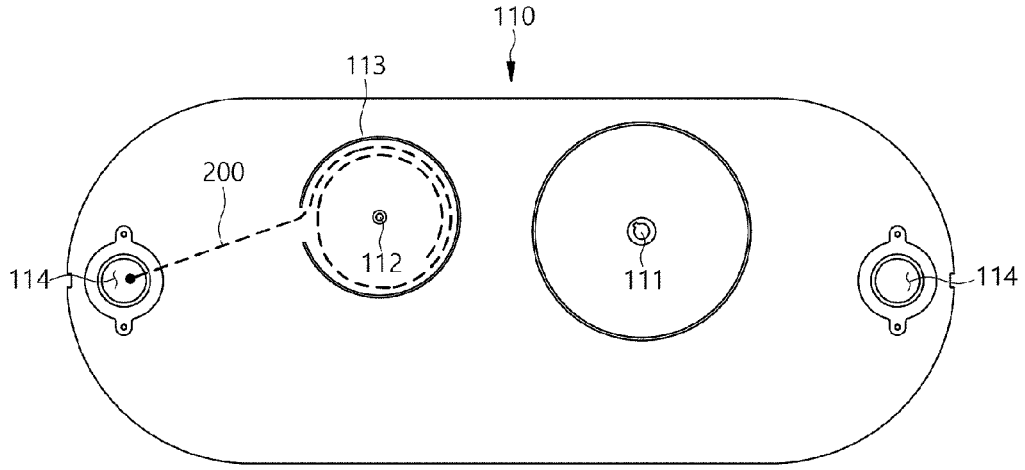
FIG. 3 is a top plan view illustrating the inside of an upper casing according to the embodiment of the present disclosure.

FIG. 2 is a top plan view illustrating the inside of the lower casing 120 according to the embodiment of the present disclosure; FIG. 3 is a top plan view illustrating the inside of the upper casing 110 according to the embodiment of the present disclosure; and FIG. 4 is a view illustrating the drive module disposed in the lower casing according to the embodiment of the present disclosure.

Figure 4:
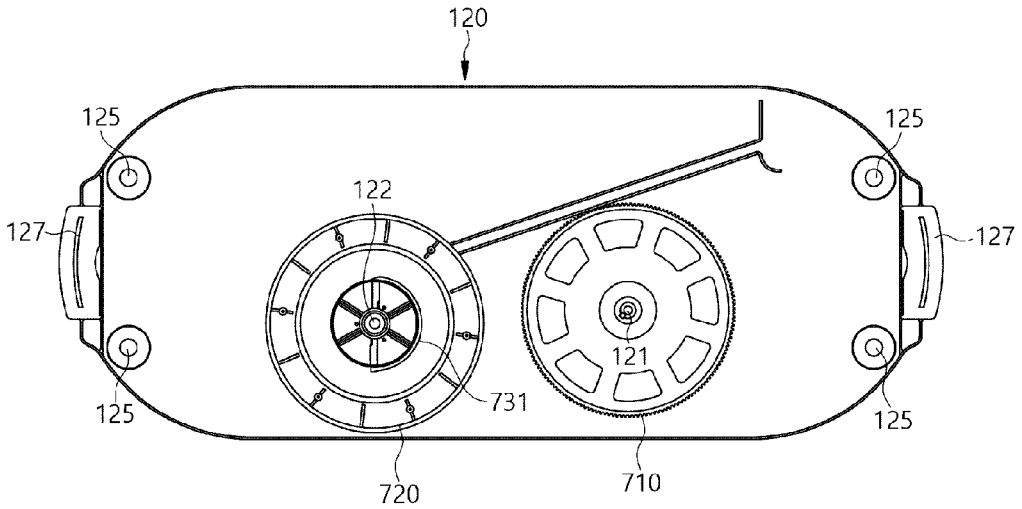
FIG. 4 is a view illustrating a drive module disposed in the lower casing according to the embodiment of the present disclosure.

As illustrated in FIG. 4, the drive module according to the embodiment of the present disclosure may include a drive motor 710. The drive motor 710 may be coupled to a lower motor shaft part 121 formed in the lower casing 120 at a position corresponding to an upper motor shaft part 111 formed in the upper casing 110 such that the drive motor 710 is installed inside the device body 100.

Figure 5:
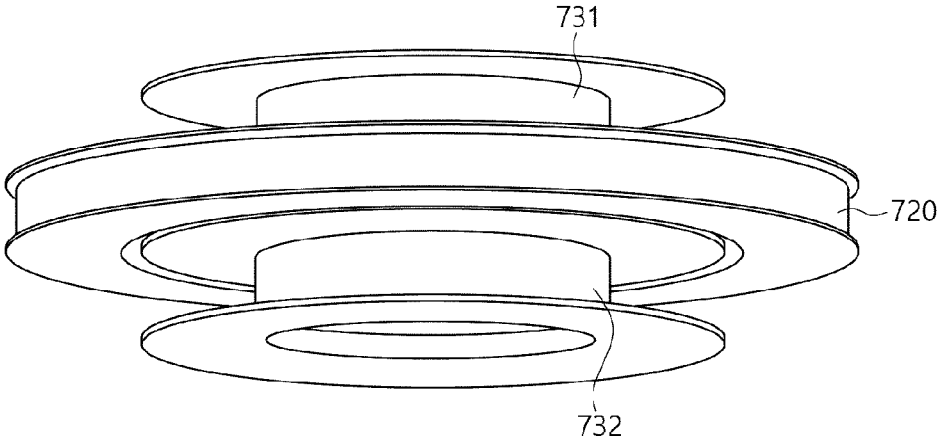
FIG. 5 is a view illustrating a differential, an upper bobbin, and a lower bobbin according to the embodiment of the present disclosure.

In addition, the drive module according to the embodiment of the present disclosure may further include a differential 720, an upper bobbin 731, and a lower bobbin 732. FIG. 5 is a view illustrating the differential 720, the upper bobbin 731, and the lower bobbin 732 according to the embodiment of the present disclosure.

The upper bobbin 731 and the lower bobbin 732 according to the embodiment of the present disclosure may share a shaft with the differential 720. Additionally, the upper shaft of the upper bobbin 731 may be installed on an upper bobbin shaft part 112 formed in the upper casing 110, and the lower shaft of the lower bobbin 732 may be installed on a lower bobbin shaft part 122 formed in the lower casing 120, and thus the upper bobbin 731, the differential 720, and the lower bobbin 732 may be installed inside the device body 100 by being stacked on each other in the direction of gravity.

The differential 720 according to the embodiment of the present disclosure may receive an exercise load from the drive motor 710, and may transmit the exercise load to each of the upper bobbin 731 and the lower bobbin 732. The differential 720 and the drive motor 710 may be connected to each other via a power transmission member such as a timing belt.

The cable 200 may be wound on each of the upper bobbin 731 and the lower bobbin 732. Additionally, ends of the cable 200 wound respectively on the upper bobbin 731 and the lower bobbin 732 may extend to the opposite sides of the device body 100, respectively, so as to be drawn to the outside. A user may perform exercise by pulling the cable 200 extending to the outside of the device body 100 and moving the same back to an initial position of the cable, and in this case, an exercise load may be adjusted by the drive motor 710 and the differential 720.

In the embodiment of the present disclosure, a cable 200 wound on the lower bobbin 732 may extend to a right side in the longitudinal direction relative to FIGS. 2 to 4 and may be moved out to the outside, and a cable 200 wound on the upper bobbin 731 may extend to a left side in the longitudinal direction and may be moved out to the outside.

Here, as illustrated in FIGS. 2 and 4, in the lower casing 120, a lower cable guide rib 124 is formed by protruding upward from the surface of the lower casing 120 so as to guide the cable 200 extending to the right side in the longitudinal direction from the lower bobbin 732. Accordingly, the movement path of the cable 200 may be stably maintained inside the device body 100.

In the embodiment of the present disclosure, the lower cable guide rib 124 may be formed on the lower casing 120, but an upper cable guide rib may be formed in the upper casing 110.

Figure 6:
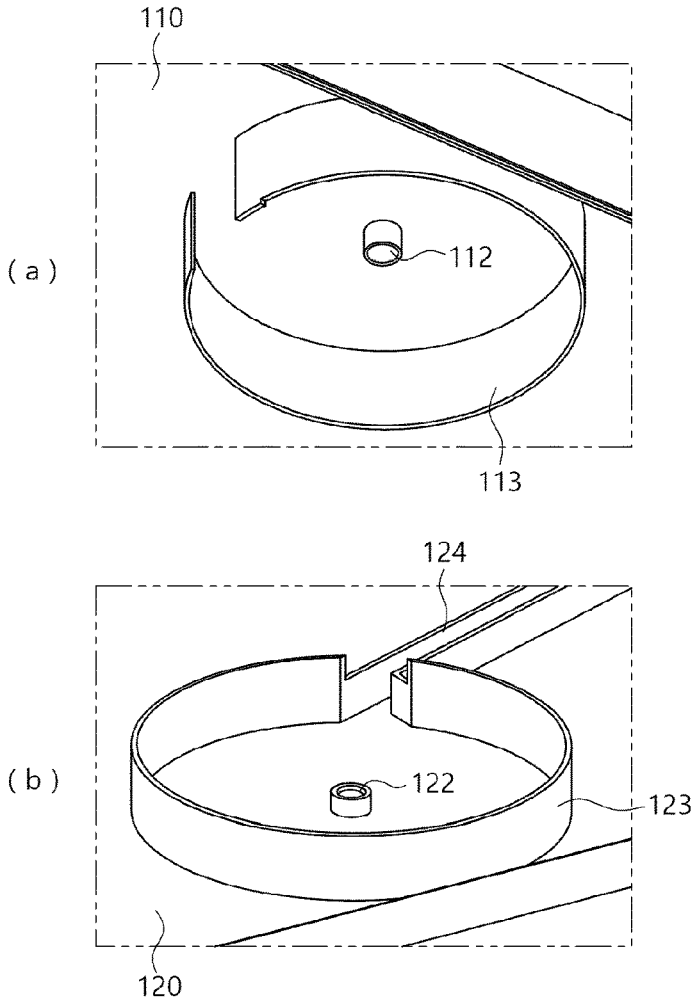
FIGS. 6(*a*) and (*b*) are views illustrating an upper removal prevention rib and a lower removal prevention rib, respectively, according to the embodiment of the present disclosure.

Meanwhile, in the embodiment of the present disclosure, as illustrated in FIGS. 6(*a*) and 6(*b*), an upper removal prevention rib 113 may be formed in the upper casing 110. Additionally, a lower removal prevention rib 123 may be formed in the lower casing 120.

The upper removal prevention rib 113 may be formed by protruding from the upper casing 110 in the form of covering the upper bobbin 731 relative to the upper bobbin shaft part 112. Likewise, the lower removal prevention rib 123 may be formed by protruding from the lower casing 120 in the form of covering the lower bobbin 732 relative to the lower bobbin shaft part 122. Accordingly, the cable 200 wound on each of the upper bobbin 731 and the lower bobbin 732 may be prevented from being removed to the outside of each of the upper bobbin 731 and the lower bobbin 732.

Here, as illustrated in FIG. 6(*b*), the lower removal prevention rib 123 may communicate with the lower cable guide rib 124, and thus the cable 200 which is located inside the lower removal prevention rib 123 and extends from the lower bobbin 732 may extend through the lower cable guide rib 124 to the outside of the device body 100.

As illustrated in FIG. 3, according to the embodiment of the present disclosure, a handle installation hole 114 through which the cable 200 extending from each of the upper bobbin 731 and the lower bobbin 732 is moved to the outside may be formed in each of opposite sides of the upper casing 110 of the device body 100 in a longitudinal direction thereof. Here, the cable 200 may be moved out to the outside through a handle guide module 500 to be described later which is installed in the handle installation hole 114, and this will be described in detail later.

Meanwhile, the mat-type exercise device 10 according to the embodiment of the present disclosure may include a plurality of wheel modules 300. Each of the plurality of wheel modules 300 may be installed in the lower casing 120 of the device body 100 such that each of wheel modules 300 can move between a protrusion position at which the wheel module protrudes from the lower surface of the device body 100 and an introduction position at which the wheel module is introduced to the inside of the lower surface of the device body 100.

In the embodiment of the present disclosure, as illustrated in FIG. 2, through a wheel moving hole 125 formed through the surface of the lower casing 120, each of the wheel modules 300 may move between the protrusion position and the introduction position. Here, the plurality of wheel modules 300 may be spaced apart from each other in width directions at the opposite edges of the device body 100 in the longitudinal direction thereof, and thus each pair of wheel modules 300, that is, four wheel modules 300 may be installed.

Figure 7:
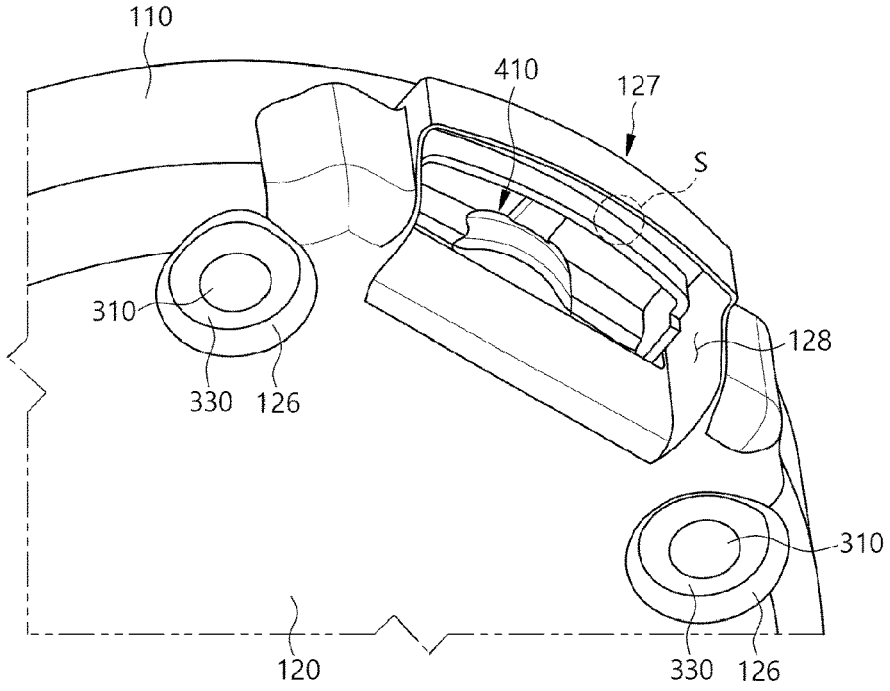
FIG. 7 is a perspective view illustrating the lower part of an edge of a device body in a longitudinal direction thereof according to the embodiment of the present disclosure.

FIG. 7 is a perspective view illustrating the lower part of an edge of the device body 100 in the longitudinal direction thereof according to the embodiment of the present disclosure.

Referring to FIG. 7, each of the pair of wheel modules 300 installed at the longitudinal directional edge may be inserted into a wheel introduction hole 126 recessed inward from the lower surface of the lower casing 120 and may move to the introduction position. Here, the wheel moving hole 125 may be formed through the inner bottom surface of each of the wheel introduction holes 126. Additionally, each of the wheel modules 300 may protrude downward from the wheel introduction hole 126 and may move to the protrusion position.

Accordingly, when the device body 100 is seated on the ground in a state in which each of the plurality of wheel modules 300 is located at the introduction position at which the wheel module is introduced into the wheel introduction hole 126, the lower surface of the device body 100 may be in close contact with the ground such that exercise can be stably performed.

On the other hand, when each of the plurality of wheel modules 300 is moved to the protrusion position to move the mat-type exercise device 10, each of the wheel modules 300 may be in contact with the ground, and the device body 100 may move in the horizontal direction of the mat-type exercise device 10 while being spaced apart from the ground.

Figure 8:
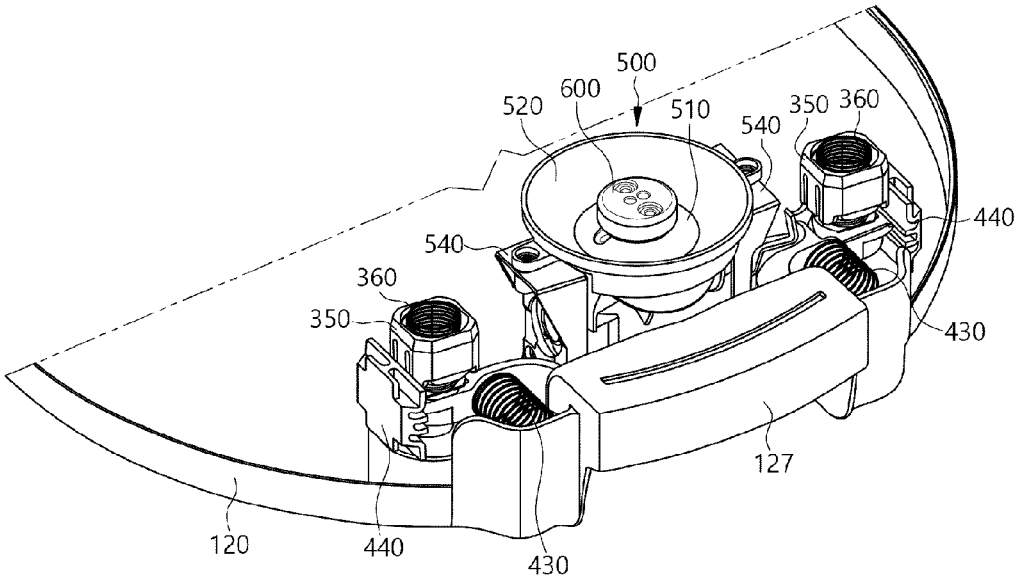
FIG. 8 is a perspective view illustrating a portion of the lower casing in which wheel modules and switching modules are installed according to the embodiment of the present disclosure.

The mat-type exercise device 10 according to the embodiment of the present disclosure may include a plurality of switching modules 400. FIG. 8 is a perspective view illustrating a portion of the lower casing 120 in which the wheel modules 300 and the switching modules 400 are installed according to the embodiment of the present disclosure, and FIG. 9 is a perspective view illustrating a state in which the lower casing 120 is removed from FIG. 8.

Figure 9:
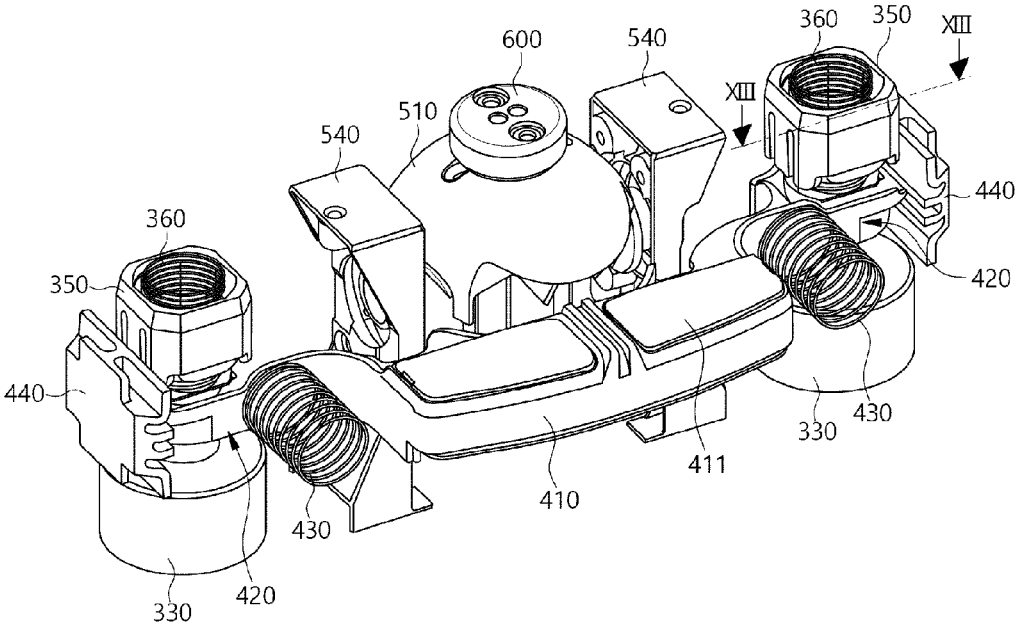
FIG. 9 is a perspective view illustrating a state in which the lower casing is removed from FIG. 8.

Referring to FIGS. 8 and 9, the plurality of switching modules 400 may switch the position of at least one of the plurality of wheel modules 300 between the protrusion position of the wheel module and the introduction position thereof. In the embodiment of the present disclosure, two switching modules 400 may be installed at each of opposite sides of the device body 100 in the longitudinal direction thereof, and may switch the positions of the pair of wheel modules 300. That is, one switching module 400 installed at a first side in the longitudinal direction may switch the positions of a pair of wheel modules 300 spaced apart from each other in the width direction, and one switching module 400 installed at a second side in the longitudinal direction may switch the positions of a pair of wheel modules 300 spaced apart from each other in the width direction.

Accordingly, a user may move the pair of wheel modules 300 between the introduction position and the protrusion position by manipulating one switching module 400, thereby manipulating the wheel module 300 more conveniently.

Figure 10:
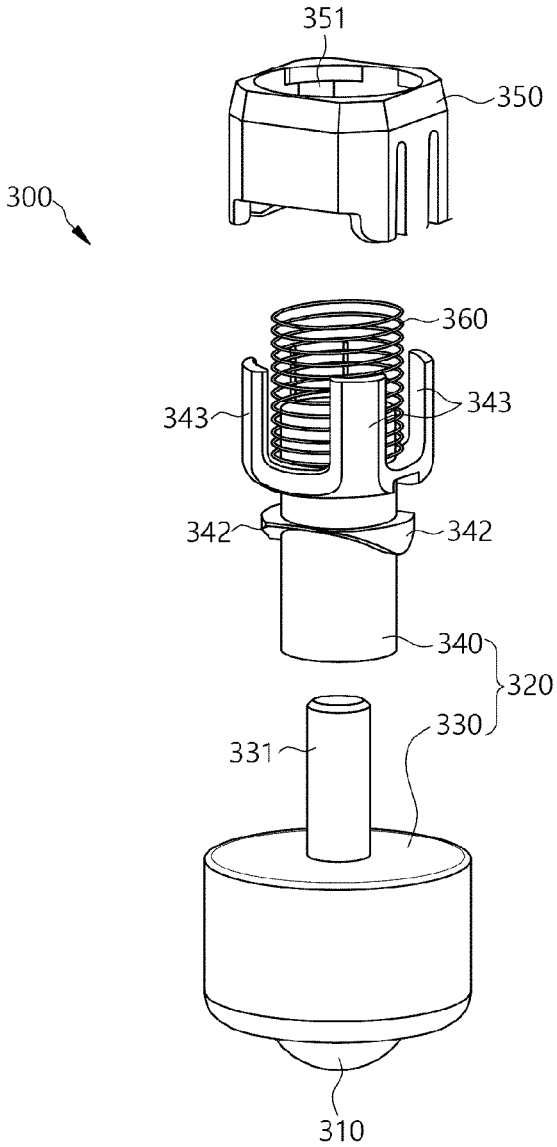
FIG. 10 is an exploded perspective view of each of the wheel modules according to the embodiment of the present disclosure.
Figure 11:
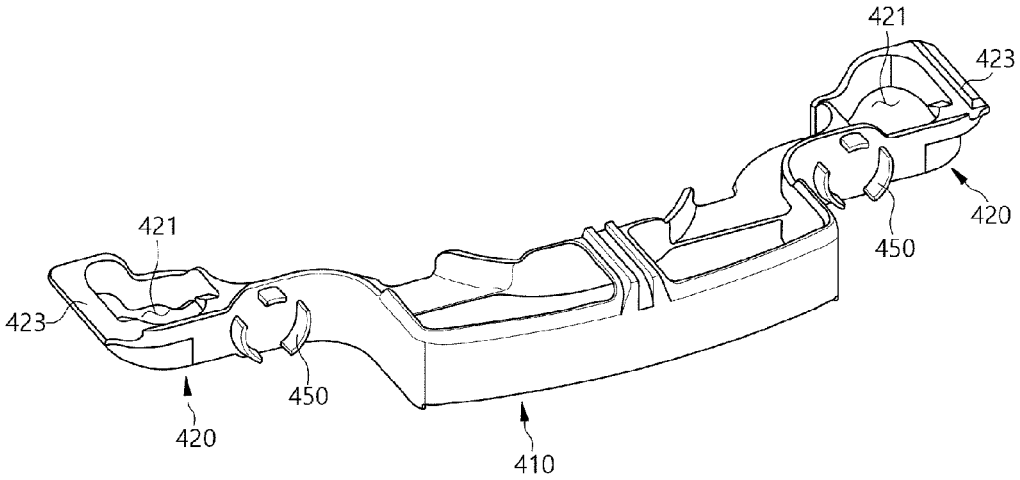
FIG. 11 is a perspective view of each of the switching modules according to the embodiment of the present disclosure.
Figure 12:
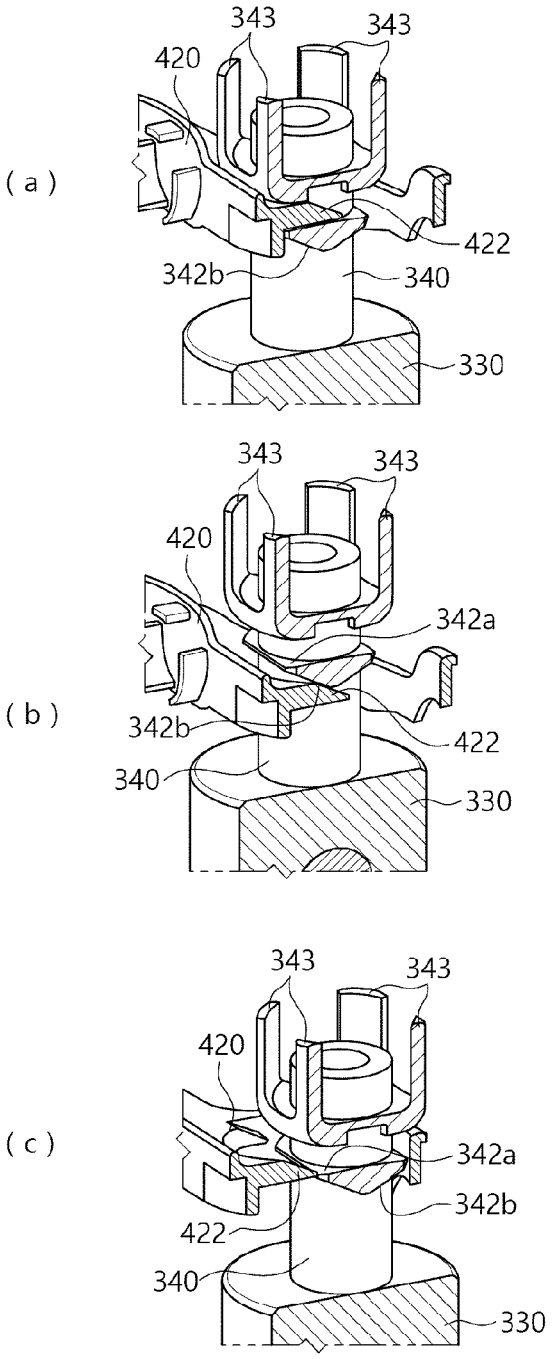
FIG. 12(*a*) to (*c*) are views illustrating the operation state of the wheel module and the switching module according to the embodiment of the present disclosure.
Figure 13:
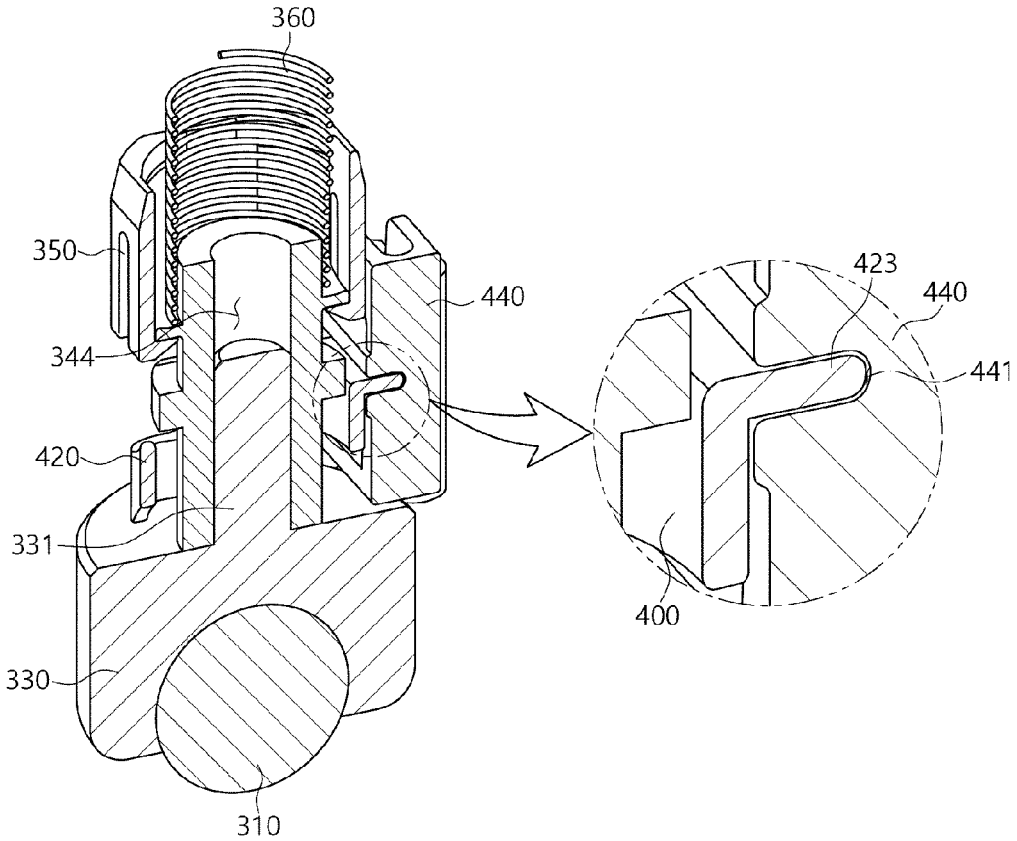
FIG. 13 is a sectional view illustrating a portion of a section taken along line XIII-XIII of FIG. 9.

FIG. 10 is an exploded perspective view of the wheel module 300 according to the embodiment of the present disclosure; FIG. 11 is a perspective view of the switching module 400 according to the embodiment of the present disclosure; FIGS. 12(*a*), 12(*b*), and 12(*c*) are views illustrating the operation state of the wheel module 300 and the switching module 400 according to the embodiment of the present disclosure; and FIG. 13 is a sectional view illustrating a portion of a section taken along line XIII-XIII of FIG. 9.

Referring to FIG. 10, the wheel module 300 according to the embodiment of the present disclosure may include a holding jaw part 342. Additionally, the wheel module 300 may further include a wheel body 320 and a moving wheel 310.

The wheel body 320 may be installed in the lower casing 120 of the device body 100 such that the wheel body 320 can move between the protrusion position and the introduction position. Additionally, the holding jaw part 342 may be formed on the wheel body 320 by protruding outward therefrom in a radial direction thereof.

The moving wheel 310 may be rotatably installed on the end of the wheel body 320 by being directed to the protrusion position. In the mat-type exercise device of the present disclosure, the moving wheel 310 is provided in the form of a caster wheel such that the moving wheel 310 can freely rotate in a horizontal direction, and accordingly, the horizontal mobility of the mat-type exercise device 10 may be increased.

The holding jaw part 342 according to the embodiment of the present disclosure may have a first surface 342*a* directed to the introduction position, and a second surface 342*b* directed to the protrusion position. Additionally, the switching module 400 may include a holding rib 422.

Referring to FIGS. 12(*a*), 12(*b*), and 12(*c*), the holding rib 422 may be in contact with the first surface 342*a* of the holding jaw part 342 at the protrusion position of the wheel module 300 as illustrated in FIG. 12(*a*) so as to maintain the protrusion position of the wheel module 300. That is, in a state in which the wheel module 300 is moved to the protrusion position, that is, in a state in which the moving wheel 310 protrudes downward from the lower casing 120, when the wheel module 300 supports the weight of the device body 100, the holding rib 422 may be in contact with the first surface 342*a* of the holding jaw part 342, and thus the movement of the wheel module 300 to the introduction position may be prevented by the weight of the device body 100.

In addition, as illustrated in FIG. 12(*b*), the holding rib 422 may be in contact with the second surface 342*b* of the holding jaw part 342 at the introduction position of the wheel module 300 so as to maintain the introduction position of the wheel module 300. That is, in a state in which the wheel module 300 is moved to the introduction position, the holding rib 422 may be in contact with the second surface 342*b* of the holding jaw part, and thus the wheel module 300 may be prevented from being moved to the protrusion position.

In the embodiment of the present disclosure, the switching module 400 is installed in the device body 100 such that the holding rib 422 can move between a holding position at which the holding rib 422 is in contact with the first surface 342*a* or the second surface 342*b* as illustrated in FIGS. 12(*a*) and 12(*b*) and a holding release position at which the holding rib 422 is released from the first surface 342*a* or the second surface 342*b* as illustrated in FIG. 12(*c*).

According to the above configuration, a user may manipulate the switching module 400 to move the switching module 400 between the holding position and the holding release position such that the wheel module 300 is moved between the protrusion position and the introduction position. More specifically, in order to move the wheel module 300 from the introduction position to the protrusion position, a user may move the switching module 400 from the holding position illustrated in FIG. 12(*b*) to the holding release position illustrated in FIG. 12(*c*) such that the holding rib in contact with the second surface 342*b* of the holding jaw part 342 is released from the second surface 342*b*.

Next, in order to move the wheel module 300 from the introduction position to the protrusion position, the switching module 400 may be moved from the holding release position back to the holding position illustrated in FIG. 12(*a*), and thus the protrusion position of the wheel module 300 may be maintained by the holding rib 422 in contact with the first surface 342*a* of the holding jaw part 342.

Here, even when moving the wheel module 300 from the protrusion position to the introduction position, the switching module 400 may be moved to the holding release position in the same manner described above, and thus the movement of the wheel module 300 may be performed.

Meanwhile, the wheel module 300 according to the embodiment of the present disclosure may further include a first elastic member 360. Here, the first elastic member 360 may press the wheel body 320 toward the protrusion position.

Accordingly, when the holding rib 422 is moved from a holding position at which the holding rib 422 is in contact with the second surface 342*b* of the holding jaw part 342 to a holding release position, the wheel body 320 may be moved to the protrusion position by the elastic force of the first elastic member 360. Accordingly, without a user artificially moving the wheel module 300 from the introduction position to the protrusion position, the wheel module 300 may be automatically moved to the protrusion position by the elastic force.

On the other hand, when the holding rib 422 is moved from a holding position at which the holding rib 422 is in contact with the first surface 342*a* of the holding jaw part 342 to the holding release position, the wheel module 300 may not be moved to the introduction position by the elastic force of the first elastic member 360, but while the device body 100 is moved toward the protrusion position in a state in which the moving wheel 310 is in contact with a floor such as the ground at the protrusion position, the weight of the device body 100 may overcome the elastic force of the first elastic member 360, and the wheel module 300 may be introduced into the device body 100.

That is, when moving the wheel module 300 to the protrusion position in a state in which the mat-type exercise device 10 is seated on the floor, a user may raise a first side of the device body 100 in the longitudinal direction while moving the switching module 400 at the first side in the longitudinal direction to the holding release position, and in this case, the wheel module 300 may be moved toward the protrusion position by the elastic force of the first elastic member 360. In this case, when a user places the device body 100 on the floor after moving the switching module 400 to the holding position, as described above, the holding rib 422 may be in contact with the first surface 342*a* of the holding jaw part 342, and thus the protrusion position of the wheel module 300 may be maintained. In the same manner, by manipulating the switching module 400 at a second side in the longitudinal direction, the wheel module 300 at the second side in the longitudinal direction may be also moved to the protrusion position.

Contrarily, when moving the wheel module 300 to the introduction position in a state in which the wheel module 300 is at the protrusion position, a user may grab and lower the first side of the device body 100 in the longitudinal direction toward the floor while moving the switching module 400 at the first side in the longitudinal direction to the holding release position, and in this case, the elastic force of the first elastic member 360 may be overcome by the weight of the device body 100, and while the device body 100 moves down toward the floor, the wheel module 300 may be moved to the introduction position. Here, when a user raises the first side of the device body 100 in the longitudinal direction, the wheel body 320 may move toward the protrusion position by the elastic force of the first elastic member 360, and the holding rib 422 and the first surface 342*a* of the holding jaw part 342 may be spaced apart from each other, so the switching module 400 may be efficiently moved from the holding position to the holding release position. Additionally, when a user moves the switching module 400 to the holding position, the holding rib 422 may be in contact with the second surface 342*b* of the holding jaw part 342, and thus the introduction position of the wheel module 300 may be maintained. In the same manner, by manipulating the switching module 400 at the second side in the longitudinal direction, the wheel module 300 at the second side in the longitudinal direction may also be moved to the introduction position.

In the embodiment of the present disclosure, as illustrated in FIGS. 12(*a*), 12(*b*), and 12(*c*), the second surface 342*b* of the holding jaw part 342 is configured to be inclined according to the moving direction of the holding rib 422. Additionally, at the introduction position, the surface of the holding rib 422 in contact with the second surface 342*b* of the holding jaw part 342 is configured to be inclined by facing the inclined surface of the second surface 342*b*.

Accordingly, at the holding position illustrated in FIG. 12(*b*), frictional force between the second surface 342*b* of the holding jaw part 342 and the holding rib 422, particularly, frictional force increased by the first elastic member 360 may be overcome, and the switching module 400 may be more efficiently moved to the holding release position.

In addition, the wheel module 300 according to the embodiment of the present disclosure may further include a wheel guide member 350.

The wheel guide member 350 may be installed inside the device body 100, and is installed in the upper casing 110 in the embodiment of the present disclosure. Here, the wheel guide member 350 may guide the movement of the wheel body 320 between the protrusion position and the introduction position.

In the embodiment of the present disclosure, a plurality of wheel guide bars 343 is formed on the wheel body 320 by protruding therefrom toward the wheel guide member 350. Additionally, the wheel guide member 350 has an opening into which the wheel guide bars 343 are inserted. Furthermore, a plurality of wheel guide grooves 351 may be formed in the inner wall surface of the wheel guide member 350 such that the wheel guide grooves 351 are located respectively at positions corresponding to the wheel guide bars 343. Accordingly, the wheel guide bars 343 may be inserted into the wheel guide grooves 351, respectively, through the opening of the wheel guide member 350, and thus the wheel guide member 350 may stably guide the movement of the wheel body 320.

Here, in a state in which the first elastic member 360 is located inside the wheel guide bars 343, the first elastic member 360 may be in contact with the upper casing 110 to supply elastic force to the wheel body. To this end, in the embodiment of the present disclosure, the upper side of the wheel guide member 350 has an opened structure as an example.

For another example, in a state in which the upper part of the wheel guide member 350 is closed, the first elastic member 360 may be configured to be installed between the wheel guide member 350 and the wheel body 320 so as to supply elastic force to the wheel body 320.

The wheel body 320 according to the embodiment of the present disclosure may include a wheel housing 330 and a moving-in/out pillar 340.

The moving wheel 310 may be rotatably coupled to the wheel housing 330. Here, as illustrated in FIG. 7, when the wheel body 320 moves to the introduction position, the wheel housing 330 may be inserted into the wheel introduction hole 126 formed in the lower casing 120, and when the wheel body 320 moves to the protrusion position, the wheel housing 330 may protrude from the lower casing 120 so as to bring the moving wheel 310 into contact with the floor.

The moving wheel 310 may be coupled to one side of the wheel housing 330. In the embodiment of the present disclosure, a coupling protrusion 331 may be formed on the wheel housing 330 by protruding therefrom toward the moving-in/out pillar 340, and a coupling hole 344 into which the coupling protrusion 331 is inserted may be formed in the moving-in/out pillar 340. Threads may be formed on the outer surface of the coupling protrusion 331 and the inner surface of the coupling hole 344 such that the moving-in/out pillar 340 and the wheel housing 330 can be screwed to each other.

Here, in the embodiment of the present disclosure, the holding jaw part 342 and the wheel guide bars 343 are formed on the moving-in/out pillar 340. In the embodiment of the present disclosure, the holding jaw part 342 includes a pair of holding jaw parts provided at the opposite sides of the radial direction of the moving-in/out pillar 340, that is, at opposite sides of the moving-in/out pillar 340 in the width direction, and accordingly, the wheel module 300 may more stably maintain the protrusion position and the introduction position thereof.

The moving-in/out pillar 340 according to the embodiment of the present disclosure may be coupled through the wheel moving hole 125 formed in the lower casing 120 to the wheel housing 330 located outside of the lower casing 120. Additionally, the moving-in/out pillar 340 may move between the protrusion position and the introduction position through the wheel moving hole 125.

As described above, the switching module 400 may be installed on each of the longitudinal opposite sides of the device body 100, and each of the switching modules 400 may include a handle part 410 and a pair of wheel switching parts 420.

The handle part 410 may be exposed to the outside of the device body 100, and a user may grab the handle part to manipulate the switching module 400. In the mat-type exercise device of the present disclosure, the handle part 410 is installed in a switching installation part 127 formed in the lower casing 120.

As illustrated in FIG. 7, the switching installation part 127 may have a shape open to the lower side, and installation space 128 in which the handle part 410 can be installed may be defined in the switching installation part 127. Additionally, when the handle part 410 is installed in the installation space 128 of the switching installation part 127, the handle part 410 may be exposed to the lower side of the switching installation part 127.

Here, the handle part 410 may be configured as a double structure in which a flexible member 411 is inserted into a lower side thereof such that a user can grip the handle part 410 more conveniently.

Through such a configuration, a user may raise the device body 100 by putting the fingers into the switching installation part 127 open to the lower side, and may also manipulate the handle part 410.

Inside the device body 100, the pair of wheel switching parts 420 may respectively extend from the handle part 410 to the opposite sides of the device body in the width direction thereof. Additionally, each of the wheel switching parts 420 may switch the position of the wheel module 300 located at each of opposite sides in the width direction.

Here, the holding rib 422 may be formed on each of the wheel switching parts 420. Additionally, manipulation by the handle part 410 may be transmitted through each of the wheel switching parts 420 to the holding rib 422 such that the holding rib 422 moves between the holding position and the holding release position.

In the embodiment of the present disclosure, the switching module 400 may be installed in the device body 100 such that the switching module 400 can reciprocate along the longitudinal direction. That is, when a user moves the handle part 410 in the longitudinal direction by gripping the handle part 410, the pair of wheel switching parts 420 extending from the handle part 410 may move in the longitudinal directions. Such reciprocation in the longitudinal direction may be transmitted to the holding rib 422, and the holding rib 422 may move between the holding position and the holding release position.

That is, when the handle part 410 moves outward in the longitudinal direction, the holding rib 422 may move to the holding release position, and when the handle part 410 moves inward in the longitudinal direction, the holding rib 422 may move to the holding position.

In the embodiment of the present disclosure, a wheel through hole 421 is formed in the wheel switching part 420. Here, the wheel through hole 421 is formed through the wheel switching part 420 to be directed toward the protrusion position of the wheel module 300 such that the wheel module 300 passes through the inside of the wheel through hole 421. That is, inside the wheel through hole 421 of the wheel switching part 420, the wheel module 300 may move between the protrusion position and the introduction position.

In addition, the holding rib 422 may protrude from the inner wall surface of the wheel through hole 421 toward the holding jaw part 342 of the wheel module 300. Accordingly, according to the reciprocation of the handle part 410 in the longitudinal direction, the holding rib 422 protruding from the inner wall surface of the wheel through hole 421 may approach or be spaced apart from the holding jaw part 342 such that the holding rib 422 moves between the holding position and the holding release position.

Here, as illustrated in FIG. 7, the handle part 410 and the switching installation part 127 may be disposed to have space therebetween such that the handle part 410 reciprocates inside the installation space 128 of the switching installation part 127. FIG. 7 illustrates the position of the handle part 410 when the holding rib 422 is located at the holding position, and when the handle part 410 is moved outward in the longitudinal direction, the holding rib 422 may be moved to the holding release position.

Meanwhile, the switching module 400 according to the embodiment of the present disclosure may further include at least one second elastic member 430 which presses at least one of the handle part 410 and the pair of wheel switching parts 420 inward in the longitudinal direction.

In the embodiment of the present disclosure, one second elastic member 430 is installed on each of the opposite sides of the handle part 410 in the width direction, and may be disposed at a portion between the handle part 410 and the wheel switching part 420.

Here, a plurality of support protrusions 450 may protrude at the installation position of the second elastic member 430 so as to prevent the removal of the second elastic member 430, and may be inserted into the second elastic member 430.

In addition, the switching module 400 according to the embodiment of the present disclosure may further include switching guide members 440.

The switching guide members 440 may be installed inside the device body 100 so as to guide the reciprocating movement of the wheel switching part 420 in a longitudinal direction thereof. In the mat-type exercise device of the present disclosure, as illustrated in FIG. 9, each of the switching guide members 440 is in contact with the outer side of each of the wheel switching parts 420 so as to guide the reciprocating movement of the wheel switching part 420.

For example, as illustrated in FIG. 13, a switching guide rib 423 protruding toward the switching guide member 440 may be formed on the wheel switching part 420. Here, the switching guide rib 423 may be formed along the longitudinal direction. Additionally, a switching guide groove 441 may be formed in the switching guide member 440, the switching guide groove 441 allowing the switching guide rib 423 to be inserted thereinto so as to guide the movement of the switching guide rib 423 in the longitudinal direction.

Accordingly, when the reciprocation of the handle part 410 is transmitted to the pair of wheel switching parts 420 extending to the opposite sides of the handle part in the width direction, the stable movement of each of the wheel switching parts 420 may be performed.

In FIG. 13, the switching guide rib 423 is formed on the wheel switching part 420, and the switching guide groove 441 is formed in the switching guide member 440, but the switching guide groove 441 may be formed in the wheel switching part 420, and the switching guide rib 423 may be formed on the switching guide member 440.

Meanwhile, the mat-type exercise device 10 according to the embodiment of the present disclosure may further include the handle guide module 500.

The handle guide module 500 according to the embodiment of the present disclosure may be installed in the device body 100 and may guide the movement of the cable 200 to the outside of the device body 100. In the embodiment of the present disclosure, as described above, the cable 200 may be moved out from each of the edges of the opposite sides of the device body in the longitudinal direction thereof, and as illustrated in FIG. 1, the handle guide module 500 may be installed on each of the edges of the opposite sides of the device body 100 in a longitudinal direction thereof.

Here, as illustrated in FIGS. 8 and 9, inside the device body 100, the handle guide module 500 is disposed between the pair of wheel modules 300. As illustrated in FIG. 11, the switching module 400 may have the handle part 410 located at a center thereof and have handle switching parts extending to the opposite sides thereof to have a bow shape, and the handle guide module 500 may be disposed between the wheel modules 300 located on the handle switching parts, respectively.

In the embodiment of the present disclosure, the cable 200 may be guided by the handle guide module 500 such that the cable 200 is moved in at least one direction along the surface of the device body 100. Accordingly, in a process in which a user performs various types of exercises by drawing the cable 200 through the handle guide module 500 to the outside, even if the cable 200 is moved in the directions of the surface of the device body 100, for example, in the longitudinal and width directions, the cable 200 may be stably supported and may be prevented from being damaged.

Figure 14:
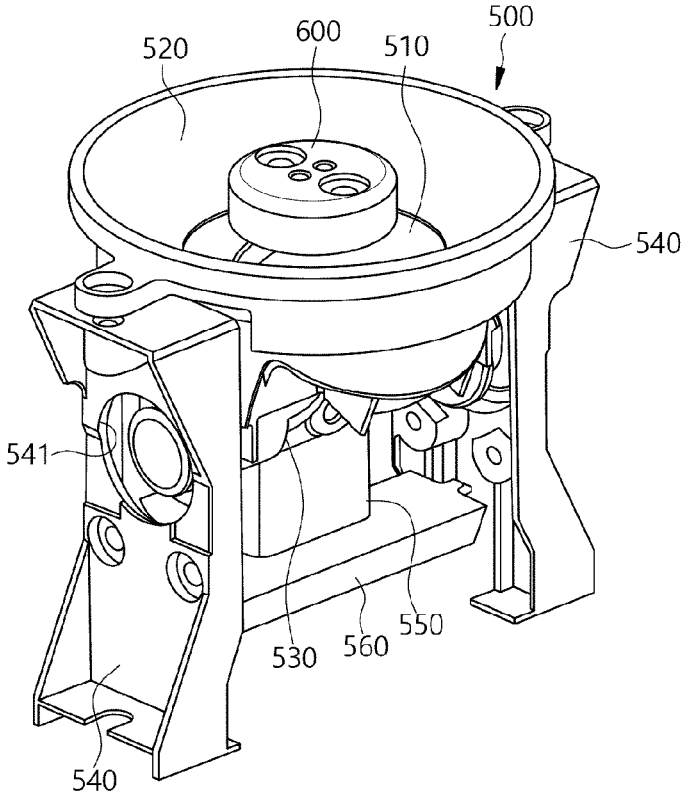
FIG. 14 is a perspective view of a handle guide module according to the embodiment of the present disclosure.
Figure 15:
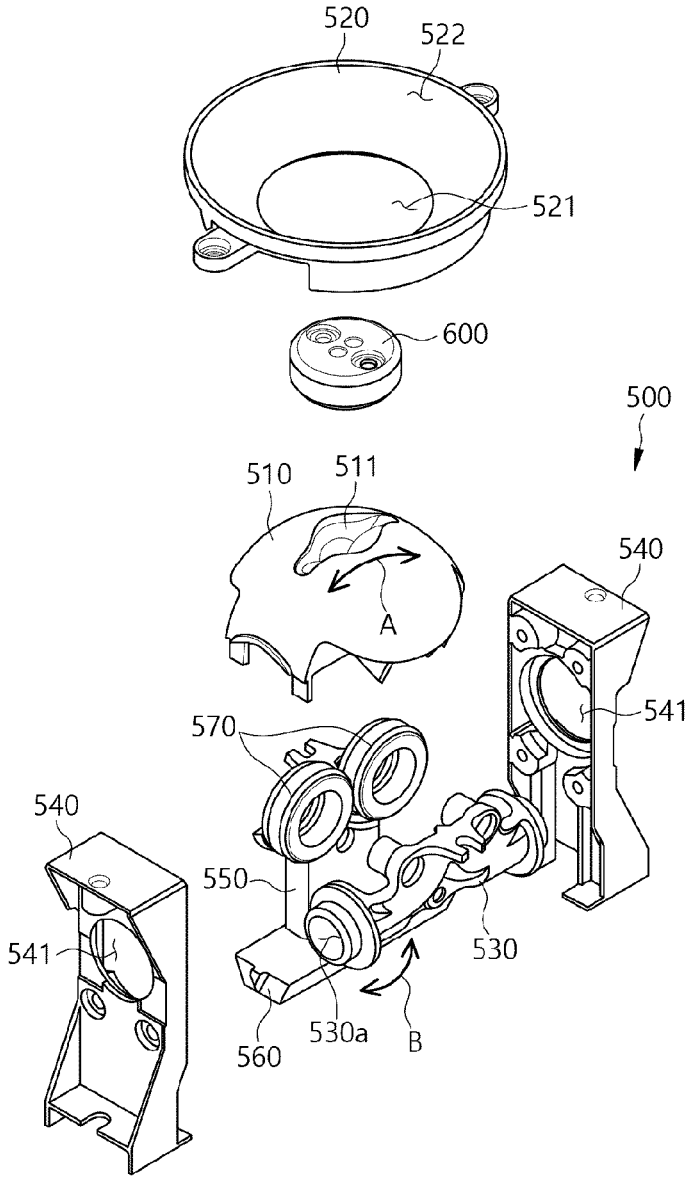
FIG. 15 is an exploded perspective view of the handle guide module according to the embodiment of the present disclosure.

FIG. 14 is a perspective view of the handle guide module 500 according to the embodiment of the present disclosure, and FIG. 15 is an exploded perspective view of the handle guide module 500 according to the embodiment of the present disclosure.

Referring to FIGS. 14 and 15, the cable 200 which is drawn by a user through the handle guide module 500 to the outside may be fastened to a handle casing 600. Various types of exercise handles may be detachably coupled to the handle casing 600. For example, opposite ends of an exercise bar may be coupled to handle casings 600 at opposite sides and thus exercise may be performed through the exercise bar. For another example, handles which a user can grip respectively with both hands may be coupled to the handle casings 600, respectively.

Here, when the mat-type exercise device 10 according to the embodiment of the present disclosure is not used, the cable 200 may be drawn into the device body 100 by the drive module, and in this case, the handle casing 600 may be held in the handle guide module 500 and may be maintained in a state illustrated in FIG. 1.

The handle guide module 500 according to the embodiment of the present disclosure may include a handle cover 510.

The handle cover 510 may be installed inside the device body 100 such that the handle cover 510 can rotate relative to a first direction as an axis. Furthermore, the handle cover 510 may guide the movement of the cable 200 in a second direction intersecting with the first direction. In the embodiment of the present disclosure, the first direction is the width direction, and the second direction is the longitudinal direction, but the first and second directions are not limited thereto.

Here, a cable moving hole 511 may be formed in the handle cover 510. The cable 200 extending from the inside of the device body may pass through the cable moving hole 511 and may extend to the outside of the device body 100, and the end of the cable 200 may be fastened to the handle casing 600.

In the embodiment of the present disclosure, the cable moving hole 511 is formed by extending in the first direction. Accordingly, the cable 200 may move along the cable moving hole 511 in the first direction.

According to the above configuration, the handle cover 510 may rotate relative to the first direction as an axis to guide the movement of the cable 200 in the second direction, and the cable moving hole 511 formed in the handle cover 510 may guide the movement of the cable 200 in the first direction, and accordingly, the movement of the cable 200 in the first direction and the second direction may be guided.

Meanwhile, as illustrated in FIG. 3, the handle guide module 500 may be exposed to the outside of the device body 100 through the handle installation hole 114 formed vertically through the surface of the upper casing 110. Here, the handle guide module 500 according to the embodiment of the present disclosure may include a discharge cover 520.

The discharge cover 520 may be installed on the handle installation hole 114 to cover the handle installation hole 114. Here, the discharge cover 520 may have a vertically penetrating shape having an upper discharge hole 522 and a lower discharge hole 521. Additionally, the discharge cover 520 may have a cone shape in which the inner diameter of the upper discharge hole 522 is larger than the inner diameter of the lower discharge hole 521.

In the embodiment of the present disclosure, the handle cover 510 may rotate relative to the first direction as an axis while the upper surface of the handle cover 510 is in contact with the lower discharge hole 521 of the discharge cover 520. Here, the upper surface of the handle cover 510 in contact with the lower discharge hole 521 may have a round dome shape. Accordingly, when the upper surface of the handle cover 510 rotates while being in contact with the lower discharge hole 521 of the discharge cover 520, the upper surface of the handle cover 510 may stably rotate due to the round shape thereof. In addition, due to the round dome shape, the handle cover 510 may rotate while being in contact with the lower discharge hole 521 of the discharge cover 520, so foreign mater may be prevented from being introduced into a gap between the handle cover 510 and the discharge cover 520.

The handle guide module 500 according to the embodiment of the present disclosure may include a handle body 550, a handle shaft member 530, and a pair of shaft support members 540.

The handle cover 510 may be coupled to the handle body 550. Furthermore, the handle shaft member 530 may be located under the handle cover 510 and may be coupled to the handle body 550.

The pair of shaft support members 540 may support the handle shaft member 530 such that the handle shaft member 530 rotates relative to the first direction as an axis. Here, the pair of shaft support members 540 may be installed in the lower casing 120 of the device body 100 and may support the entirety of the handle guide module 500 according to the embodiment of the present disclosure.

According to the above-described configuration, the rotation of the handle shaft member 530 may be transmitted through the handle body 550 to the handle cover 510, and thus the handle cover 510 may rotate relative to the first direction as an axis.

In addition, in the embodiment of the present disclosure, the handle body 550 may extend from the handle shaft member 530 toward a side under the handle shaft member 530. Additionally, for example, a weight 560 may be provided on the lower end of the handle body 550. Accordingly, the weight 560 may be located at a lower side relative to the handle shaft member 530, and the center of gravity of the handle body 550 may be formed at a side lower than the handle shaft member 530. Accordingly, when no exercise load is applied and a user does not exercise, the handle body 550 may be maintained in a vertical direction.

The handle guide module 500 according to the embodiment of the present disclosure may further include a pair of cable guide wheels 570. The pair of cable guide wheels 570 may be installed on the handle body 550 such that the pair of cable guide wheels 570 is located between the handle cover 510 and the handle shaft member 530. Additionally, the cable guide wheels 570 may guide the movement of the cable 200, with the cable 200 extending to the handle cover 510 being placed between the cable guide wheels 570.

Here, a shaft hole 541 may be formed in each of the shaft support members 540 such that each of the opposite ends of the handle shaft member 530 is rotatably inserted into the shaft hole. Additionally, a through hole 530*a* may be formed in any one side of the opposite ends of the handle shaft member 530 by passing therethrough in the first direction.

Through the above configuration, the cable 200 may extend from the inside of the device body 100 and may be introduced through the shaft hole 541 and the through hole 530*a* into the handle guide module 500, and may be fastened to the handle casing 600 through the pair of cable guide wheels 570 and the cable moving hole 511 of the handle cover 510.

Although the embodiment of the present disclosure has been described above with reference to the accompanying drawings, the exercise device of the present disclosure is not limited to the above embodiment, but may be manufactured in various different forms. Those skilled in the technical field to which the present disclosure belongs will be able to understand that the exercise device of the present disclosure may be embodied in other specific forms without changing the technical idea or essential characteristics of the present disclosure. Therefore, it should be understood that the embodiment described above is illustrative in all respects and not restrictive.

INDUSTRIAL APPLICABILITY

The mat-type exercise device of the present disclosure may be applied to the field of an exercise device for muscle exercise.

The invention claimed is:

1. A mat-type exercise device comprising, a device body which provides an exercise load;

a cable which extends to an outside from the device body and transmits the exercise load from the device body;

a plurality of wheel modules installed in the device body such that each of the wheel modules is capable of moving between a protrusion position at which the wheel module protrudes from a lower surface of the device body and an introduction position at which the wheel module is introduced to an inside of the lower surface of the device body; and a plurality of switching modules which switch a position of at least one of the plurality of wheel modules between the protrusion position and the introduction position, wherein the plurality of wheel modules are installed in pairs by being spaced apart from each other in width directions of the device body on opposite edges of the device body in longitudinal directions thereof, the plurality of switching modules are installed respectively on longitudinal opposite sides of the device body and switches a position of each of the pairs of wheel modules, the wheel module comprises a holding jaw part having a first surface directed to the introduction position and a second surface directed to the protrusion position, and each of the switching modules comprises a holding rib which is in contact with the first surface of the holding jaw part when the wheel module is located at the protrusion position such that the wheel module is maintained at the protrusion position, and which is in contact with the second surface of the holding jaw part when the wheel module is located at the introduction position such that the wheel module is maintained at the introduction position.

2. The device of claim 1, wherein the switching module is installed in the device body such that the holding rib is capable of moving between a holding position at which the holding rib is in contact with the first surface or the second surface and a holding release position at which the holding rib is removed from the first surface or the second surface.

3. The device of claim 2, wherein the wheel module further comprises:

a wheel body which is installed in the device body such that the wheel body is capable of moving between the protrusion position and the introduction position, and has the holding jaw part formed on an outer side of the wheel body in a radial direction thereof;

a moving wheel installed on an end of the wheel body by being directed to the protrusion position; and a first elastic member which presses the wheel body toward the protrusion position, and wherein when the holding rib moves from the holding position at which the holding rib is in contact with the second surface of the holding jaw part to the holding release position, the wheel body is moved toward the protrusion position by an elastic force of the first elastic member.

4. The device of claim 3, wherein when the holding rib moves from the holding position at which the holding rib is in contact with the first surface of the holding jaw part to the holding release position, the device body moves toward the protrusion position while the moving wheel is in contact with a floor, and weight of the device body overcomes the elastic force of the first elastic member, and thus the wheel body is introduced into the device body.

5. The device of claim 3, wherein each of the second surface of the holding jaw part and a surface of the holding rib in contact with the second surface when the wheel module is located at the introduction position is formed slantingly along a moving direction of the holding rib such that the second surface of the holding jaw part and the surface of the holding rib in contact with the second surface face each other.

6. The device of claim 3, wherein the wheel module is installed inside the device body and further comprises a wheel guide member which guides the movement of the wheel body between the protrusion position and the introduction position.

7. The device of claim 6, wherein the wheel body has a plurality of wheel guide bars protruding toward the wheel guide member; and the wheel guide member has an opening into which the wheel guide bars are inserted, and a plurality of wheel guide grooves which is formed respectively at positions of an inner wall surface of the wheel guide member, which correspond to the wheel guide bars, the wheel guide grooves being configured to guide movements of the wheel guide bars when the wheel body moves.

8. The device of claim 1, wherein the switching module comprises:

a handle part exposed to the outside of the device body such that a user grips the handle part; and a pair of wheel switching parts which extends respectively to opposite sides of the width direction from the handle part inside the device body and switches the positions of the pair of wheel module, respectively;

the holding rib is formed in each of the wheel switching parts, and manipulation by the handle part is transmitted through the wheel switching part to the holding rib such that the holding rib moves between a holding position of the holding rib and a holding release position thereof.

9. The device of claim 8, wherein the handle part and the pair of wheel switching parts are installed in the device body so as to reciprocate along the longitudinal direction of the device body, and when the handle part moves outward in the longitudinal direction, the holding rib moves to the holding release position, and when the handle part moves inward in the longitudinal direction, the holding rib moves to the holding position.

10. The device of claim 9, wherein the switching module further comprises at least one second elastic member which presses at least one of the handle part and the pair of wheel switching parts inward in the longitudinal direction, and the holding position of the holding rib is maintained by an elastic force of the second elastic member.

11. The device of claim 9, wherein the wheel switching part has a wheel through hole formed through the wheel switching part toward the protrusion position such that the wheel module passes through an inside of the wheel through hole, and the holding rib is formed by protruding from an inner wall surface of the wheel through hole toward the wheel module.

12. The device of claim 11, wherein the switching module further comprises a switching guide member which is installed inside the device body and guides reciprocating movement of the wheel switching part in the longitudinal direction of the device body, wherein a switching guide rib is formed on one of the switching guide member and the wheel switching part along the longitudinal direction by protruding toward a remaining one of the switching guide member and the wheel switching part, and a switching guide groove is formed in the remaining one of the switching guide member and the wheel switching part, the switching guide groove allowing the switching guide rib to be inserted thereinto such that movement of the switching guide rib in the longitudinal direction is guided.

* * * * *